US005882132A

United States Patent [19]

Kageyama et al.

[11] Patent Number: 5,882,132

[45] Date of Patent: Mar. 16, 1999

[54] SIDE KNOCK-TYPE MECHANICAL PENCIL

[75] Inventors: Hidehei Kageyama; Yoshio Noguchi, both of Kawagoe, Japan

[73] Assignee: Kotobuki & Co., Ltd., Kyoto, Japan

[21] Appl. No.: 960,346

[22] Filed: Oct. 29, 1997

[30] Foreign Application Priority Data

Oct. 31, 1996 [JP] Japan ..... 8-304128

[51] Int. Cl.[6] ..... B43K 21/027

[52] U.S. Cl. ..... 401/56; 401/65; 401/85

[58] Field of Search ..... 401/65, 56, 85, 401/92

[56] References Cited

U.S. PATENT DOCUMENTS

| | | | |
|---|---|---|---|
| 1,490,124 | 4/1924 | Netter | 401/85 X |
| 1,503,506 | 8/1924 | Keeran | 401/85 X |
| 2,492,839 | 12/1949 | Brubaker | 401/56 X |
| 3,836,264 | 9/1974 | Saito et al. | 401/65 |
| 3,883,253 | 5/1975 | Naruse et al. | 401/65 |
| 4,358,210 | 11/1982 | Hashimoto et al. | 401/65 |
| 4,619,539 | 10/1986 | Kageyama | 401/65 X |
| 4,687,363 | 8/1987 | Kageyama | 401/65 |
| 4,955,739 | 9/1990 | Kageyama et al. | 401/65 |
| 5,009,533 | 4/1991 | Kageyama | 401/65 |
| 5,702,193 | 12/1997 | Kageyama et al. | 401/65 |

*Primary Examiner*—David J. Walczak
*Assistant Examiner*—Kathleen J. Prunner
*Attorney, Agent, or Firm*—Rothwell, Figg, Ernst & Kurz, P.C.

[57] ABSTRACT

A side knock-type mechanical pencil comprises: a barrel, a push member supported on the side wall of the barrel, and a sliding tube longitudinally slidably inserted in the barrel so as to correspond to the push member and internally provided with a lead passage. An angular cam portion formed in a middle portion of the sliding tube has a stepped surface consisting of a high slope and a pair of low slopes. The pair of side members of the push member touch the pair of low slopes in the initial stage of the pushing operation, and the top member which joins the pair of side members the high slope in a final stage of the pushing operation. The axis of a back portion is displaced from the axis of the barrel to a side opposite the side of the push member. A funnel-shaped lead receiving portion is formed integrally with the back portion at the back end of the same.

20 Claims, 5 Drawing Sheets

SIDE KNOCK-TYPE MECHANICAL PENCIL

BACKGROUND OF THE INVENTION

1. Field of the Invention

The present invention relates to a side knock-type mechanical pencil provided with a push member pivotally supported to the side wall of a barrel so as to be operated to cause a sliding member to slide longitudinally for projecting a lead.

2. Prior Art

Various side knock-type mechanical pencils have been proposed. Referring now to FIG. 1 illustrating a side knock-type mechanical pencil disclosed in Japanese Utility Model Publication No. 51-17942, a push lever 22 is received in a slot 21 formed in the side wall of a barrel 20 containing a lead chucking mechanism therein, and supported at one end thereof to the barrel 20. The push lever 22 is adapted to be pushed with a fingertip to advance a lead.

When the push lever 22 is pushed or knocked, a free end 22*a* of the push lever 22 engages with an inclined surface 24*a* formed on a sliding member 24 mounted on an elongated cylindrical portion 27 of a chuck 26 connected to a lead tank 23, and advances the chuck 26 against a force of a spring 25 biasing the chuck 26 backward. As the chuck 26 is moved forward, it is opened to permit a lead to advance forward relative to the chuck 26.

Whereas there is no restrictions on the diameter of the barrels of end knock-type mechanical pencils, there is a limit to the diameter of the barrels of those side knock-type mechanical pencils. Therefore, in the prior art side knock-type mechanical pencil, the lead can be advanced by a short distance by one lead advancing stroke of the chuck which is caused by one stroke of the push lever, and hence the push lever needs to be pushed many times to advance the lead from the lead tank so that the lead can be projected, which requires a troublesome operation. If it is desired to increase the lead advancing stroke of the chuck beyond a limit, the diameter of the barrel must be greatly increased, and an increased pressure is necessary for pushing the push lever because the point of engagement of the push lever and the inclined surface of the sliding member moves down beyond the center axis of the elongated portion of the chuck.

SUMMARY OF THE INVENTION

Accordingly, it is an object of the present invention to improve the lead advancing performance of a side knock-type mechanical pencil by increasing the lead advancing stroke without requiring the significant increase of the diameter of the barrel of the side knock-type mechanical pencil.

Another object of the present invention is to provide an inexpensive side knock-type mechanical pencil provided with a side-push mechanism comprising a relatively small number of parts, a cushion sleeve and the like which can be assembled by simple assembling work, and capable of being easily assembled.

A side knock-type mechanical pencil according to one aspect of the present invention comprises: a barrel; a push member supported on a wall of the barrel; and a sliding member longitudinally slidably inserted in the barrel so as to correspond to the push member and internally provided with a lead passage. An angular cam portion formed in a middle portion of the sliding member has a stepped surface consisting of a high slope and a pair of low slopes, with the advancing member in the preferred embodiment having a push member having a pair of side members joining a top member, with the side members touching the low slopes in an initial stage of a pushing operation, and the top member of the push member touching the high slope in a final stage of the pushing operation.

A side knock-type mechanical pencil in another aspect of the present invention comprises: a barrel; a push member supported on a wall of the barrel; and a sliding member longitudinally slidably inserted in the barrel so as to correspond to the push member and internally provided with a lead passage. A center axis of a cylindrical portion of the sliding member with which the push member comes into contact is displaced from a center axis of the sliding member relative to the barrel toward a side opposite the side of the push member.

A side knock-type mechanical pencil according to a third aspect of the present invention comprises: a barrel; a sleeve inserted in the barrel; a push member; and a one-piece sliding member having a stepped forward portion, an angular cam portion with which a push member included in the side-push mechanism comes into contact, and a lead receiving portion extending behind the angular cam portion and having an outside diameter approximately equal to the inside diameter of the barrel, and provided with an axial lead passage extended through the angular cam portion and the lead receiving portion. The stepped forward portion pushes a projection formed in the sleeve into a hole formed in the side wall of the barrel when fitting the projection of the sleeve in the hole of the barrel.

DETAILED DESCRIPTION OF THE PREFERRED EMBODIMENT

Figure 1:
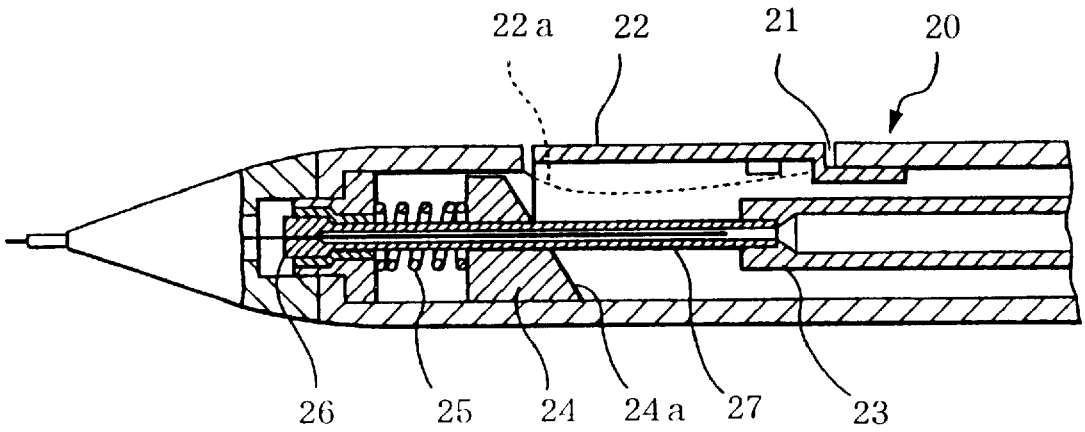
FIG. 1 (PRIOR ART)
FIG. 1 is a fragmentary longitudinal sectional view of a conventional side knock-type mechanical pencil.
Figure 2:
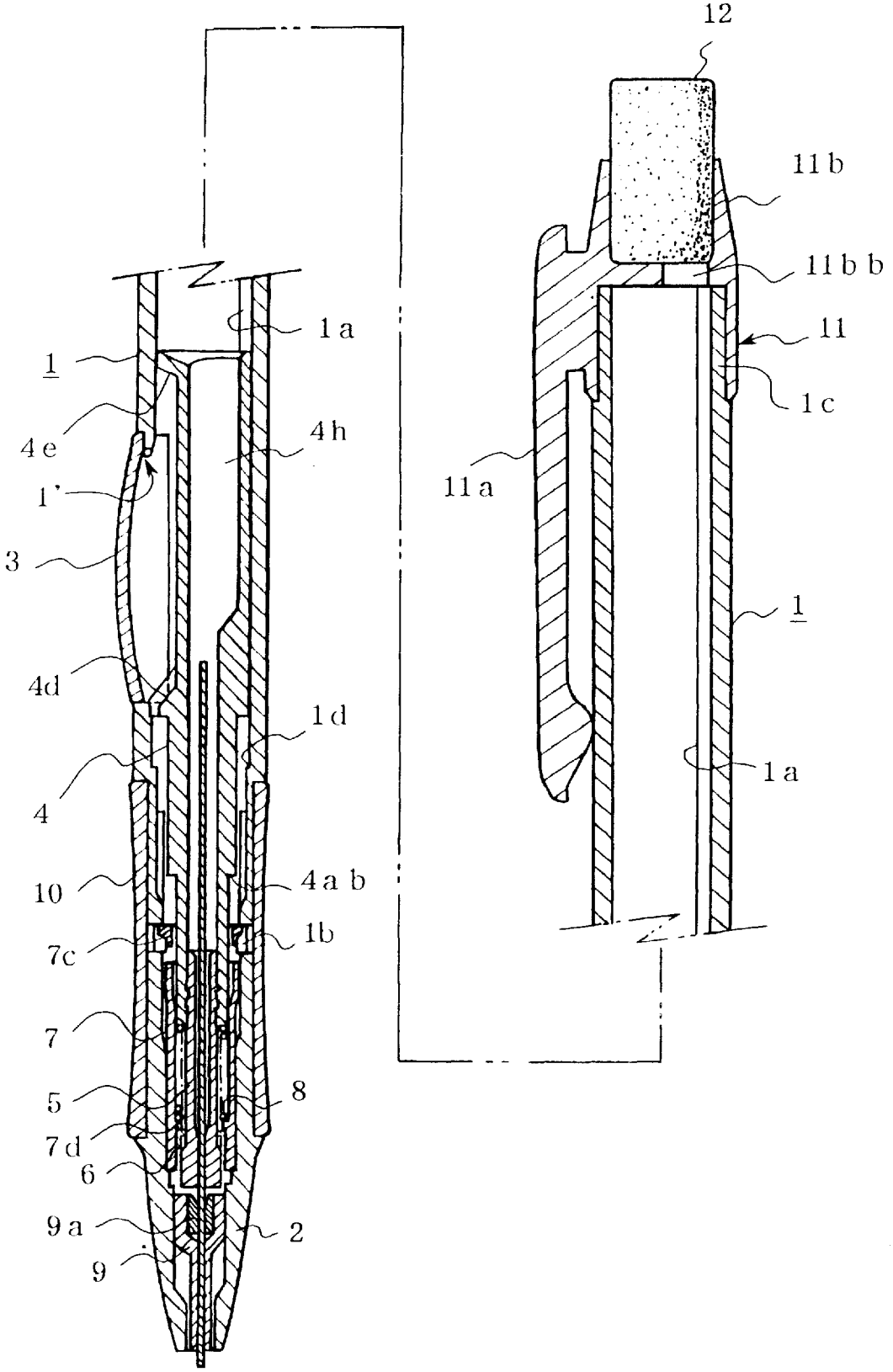
FIG. 2 is a longitudinal sectional view of a side knock-type mechanical pencil in a preferred embodiment according to the present invention.
Figure 3:
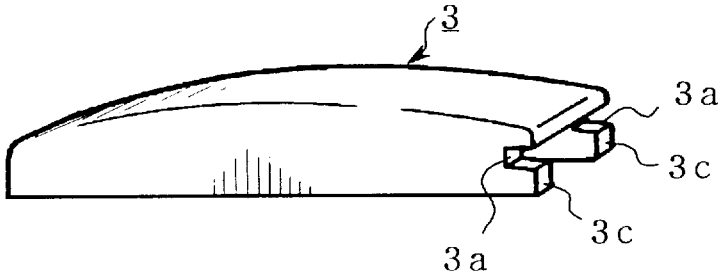
FIG. 3 is a perspective view of a push member included in the side knock-type mechanical pencil of FIG. 1.
Figure 4:
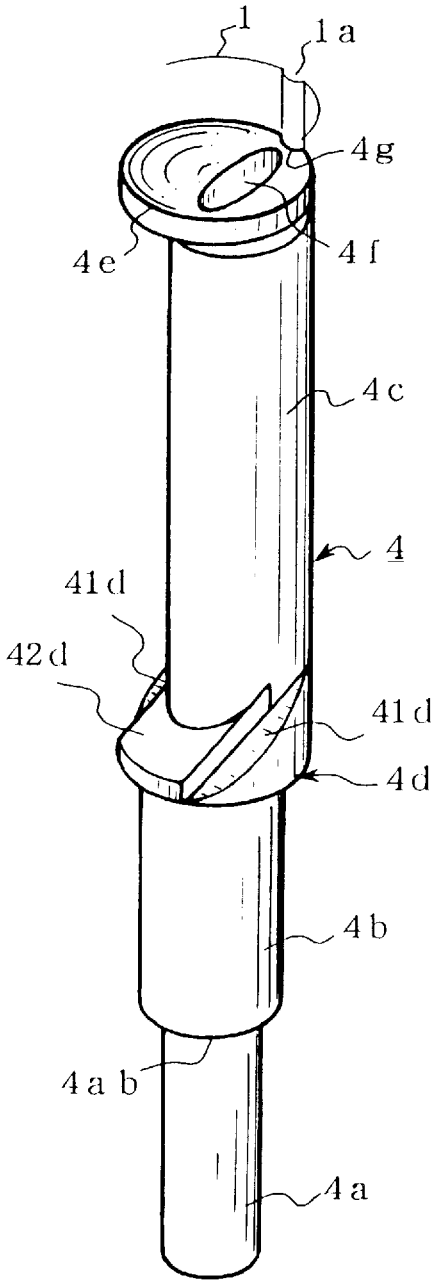
FIG. 4 is a perspective view of a sliding tube included in the side knock-type mechanical pencil of FIG. 1.

A preferred embodiment of the present invention will be described hereinafter with reference to the accompanying drawings. Referring to FIGS. 2 to 4 showing a side knock-type mechanical pencil in a preferred embodiment according to the present invention, a side-knock mechanism is disposed in a forward portion of a barrel 1 integrally provided with a head cap 2.

The side-knock mechanism includes a push or knock member 3 comprising a substantially U-shaped body in cross section. The push member 3 is received in a slot 1' formed in the side wall of the barrel 1, and pivotally supported to a portion of the side wall surrounding the slot 1'. More particularly, the substantially U-shaped knock member 3 has notches 3*a* formed in the back ends of the side sections thereof as shown in FIG. 3.

The knock member 3 is supported to the portion of the side wall surrounding the slot 1' with the notches 3*a* thereof receiving the portion of the side wall. Thus, the knock member 3 is adapted to pivot about a support point thereof.

A sliding tube 4 is inserted in the barrel 1 so as to be moved longitudinally in the barrel 1 by the push member 3. More specifically, the sliding tube 4 has a front portion 4*a*, a middle portion 4*b* and a back portion 4*c* as best shown in FIG. 4.

The front portion 4*a* has a relatively small outside diameter, the middle portion 4*b* has a relatively large outside diameter, and a step 4*ab* is formed between the front portion 4*a* and the middle portion 4*b*. The front portion 4*a* and the middle portion 4*b* are coaxial with the barrel 1. The axis of the back portion 4*c* is displaced from the axis of the barrel 1 to a side opposite the side of the push member 3 in view of technical effects.

An angular cam portion 4*d* with which the push member 3 comes into engagement to move the sliding tube 4 is formed between the middle portion 4*b* and the back portion 4*c*. The angular cam portion 4*d* has an inclined surface declined backward and consisting of a pair of low side slopes 41*d* and a high middle slope 42*d* formed between the pair of low side slopes 41*d*.

A funnel-shaped lead receiving portion 4*e* of an outside diameter slightly smaller than the inside diameter of the barrel 1 is formed integrally with the back portion 4*c* at the back end of the same. As shown in FIG. 2, a lead passage 4*h* is formed through the back portion 4*c* with its axis displaced from that of the lead receiving portion 4*e*, and an oval opening 4*f* (FIG. 4) is formed in the lead receiving portion 4*e* so as to communicate with the lead passage 4*h*. As shown in FIG. 4, a longitudinally extending groove 4*g* is formed in the side surface of the sliding tube 4. Bearing on this, a longitudinally extending rib 1*a* is formed on the inner circumference of the barrel 1 as illustrated in FIG. 2. The rib 1*a* is fitted in the longitudinal groove 4*g* when the sliding tube 4 is inserted in the barrel 1 for assembly.

A lead chuck 5 is press-fitted in the front portion 4*a* of the sliding tube 4, and a chuck ring 6 is loosely put on the lead chuck 5. A plastic cushion sleeve 7 is inserted in and fixed to the barrel 1 so as to surround the lead chuck 5 and the chuck ring 6.

Figure 5:
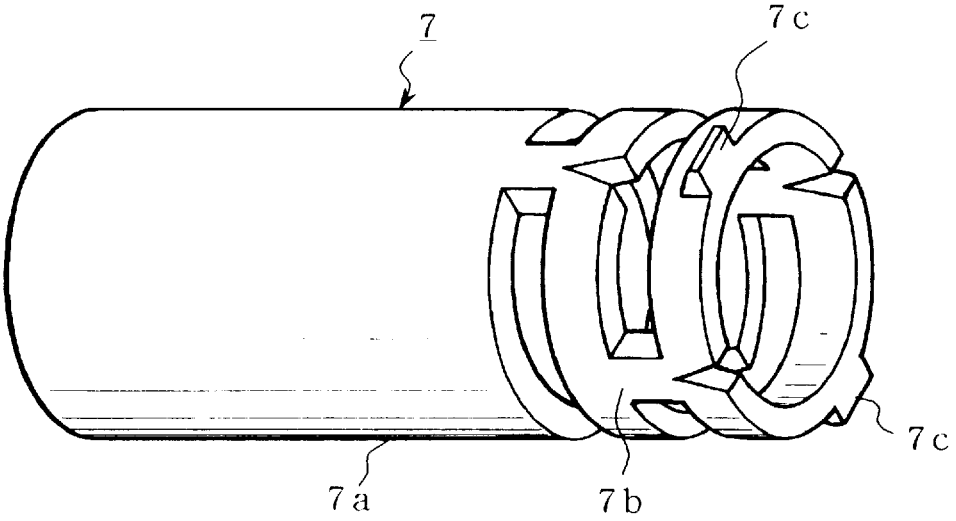
FIG. 5 is a perspective view of a cushion sleeve included in the side knock-type mechanical pencil of FIG. 1.

As shown in FIG. 5, the cushion sleeve 7 has a tubular body 7*a*, and a spring portion 7*b* provided with a pair of projections 7*c* projecting radially from the outer circumference thereof. The projections 7*c* are fitted in holes 1*b*, which are formed in the barrel 1, when the cushion sleeve 7 is inserted in the barrel 1 for assembly.

A circular ridge 7*d* (FIG. 2) is formed on the inner circumference of a front portion of the cushion sleeve 7, and a spring 8 is interposed between the circular ridge 7*d* and the sliding tube 4 to bias the sliding tube 4 backward.

A hollow slider 9 for holding a lead is slidably fitted in the head cap 2 formed integrally with a front portion of the barrel 1. A frictional member 9*a* of rubber or the like is fixedly fitted in a back portion of the slider 9. An elastic grip member 10 is put on a portion of the barrel 1 in which the barrel is gripped.

The barrel 1 has a reduced end portion 1*c*, and an eraser holding member 11 formed integrally with a clip 11*a* is put on the reduced end portion 1*c*. An eraser 12 is detachably fitted in an eraser holding portion 11*b* of the eraser holding member 11. An eccentric opening 11*bb* to receive leads therethrough is formed in the bottom wall of the eraser holding portion 11*b*.

An assembling procedure for assembling the side knock-type mechanical pencil embodying the present invention will be described for assistance in understanding the features of the present invention. The slider 9 is inserted in the barrel 1 integrally provided with the head cap 2 through the open back end of the barrel 1. The lead chucking mechanism including the sliding tube 4 is pressed into the barrel 1 through the open back end of the same so that the lead chucking mechanism is set in place in the barrel 1. As described above, the step 4*ab* is formed between the front portion 4*a* and the middle portion 4*b*. When the sliding tube 4 is inserted in the barrel 1, the shoulder 4*ab* comes into contact with the projections 7*c* of the cushion sleeve 7 and pushes out the spring portion 7*b* forcibly while causing the spring portion 7*b* to be compressed, so that the projections can be easily and surely set in the holes 1*b* of the barrel 1.

The push member 3 is set on the side wall of the barrel with its notches 3*a* engaged with one edge of the slot 1' previously formed in the barrel 1. A plurality of leads are supplied into the barrel 1 through the open back end of the barrel 1. The eraser holding portion 11*b* formed integrally with the clip 11*a* is put on the reduced end portion 1*c* of the barrel 1. The eraser 12 may be fitted in the eraser holding portion 11*b* of the eraser holding member 11 before putting the eraser holding member 11 on the barrel 1.

The elastic grip member 10 may be put on the barrel 1 in the early stage of the assembling work. However, it is preferable to put the elastic grip member 10 on the barrel in the last step of the assembling work to enable the confirmation of the fitting of the projections 7*c* of the cushion sleeve 7 in the holes 1*b* of the barrel 1.

Figure 6:
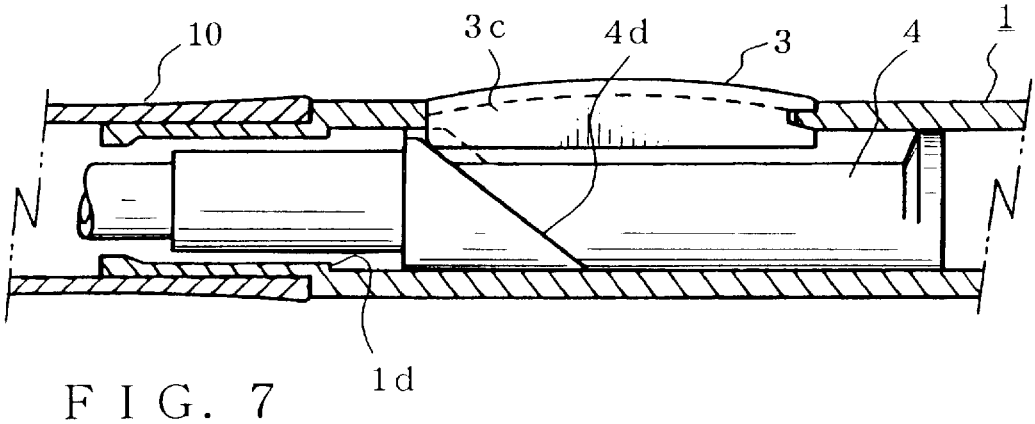
FIG. 6 is a longitudinal sectional view of an essential portion of the side knock-type mechanical pencil of FIG. 1 and of assistance in explaining the positional relation between a push member and a sliding tube included in the side knock-type mechanical pencil of FIG. 1 in a state where the push member is not depressed.

The operation of the side knock-type mechanical pencil thus constructed will be described with reference to FIGS. 6 to 8. Referring to FIG. 6 showing an essential portion of the side knock-type mechanical pencil in a state where the U-shaped push member 3 is not depressed, the side members 3*c* of the U-shaped push member 3 are in contact with the low side slopes 41*d* (FIG. 4) of the angular cam portion 4*d*, and the sliding tube 4 is biased to the back end position in the barrel 1 by the spring 8.

Figure 7:
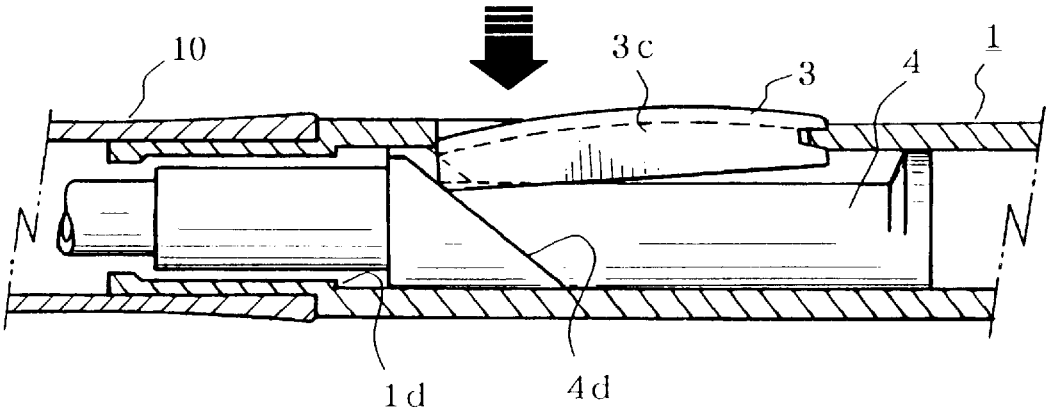
FIG. 7 is a longitudinal sectional view of an essential portion of the side knock-type mechanical pencil of FIG. 1 and of assistance in explaining the positional relation between the push member and the sliding tube in a state where the push member is depressed halfway down.

Referring to FIG. 7 showing the side knock-type mechanical pencil in a state where the push member 3 is depressed halfway, the tips of the side members 3*c* of the push member 3 are sliding down the low side slopes 41*d* (FIG. 4) of the angular cam portion 4*d* of the sliding tube 4, while the sliding tube 4 is advanced axially in the barrel 1, so that the lead chuck 5 is advanced.

Figure 8:
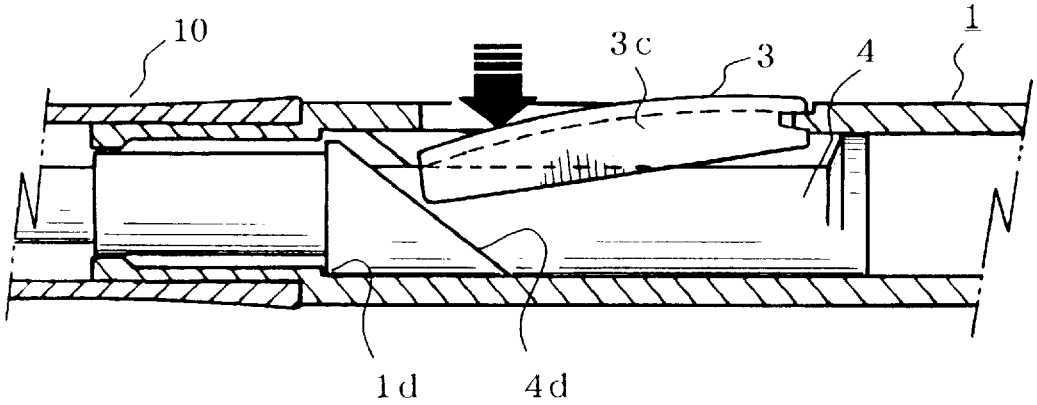
FIG. 8 is a longitudinal sectional view of an essential portion of the side knock-type mechanical pencil of FIG. 1 and of assistance in explaining the positional relation between the push member and the sliding tube in a state where the push member is fully depressed.

Referring to FIG. 8 showing the sectional view of an essential portion of the side knock-type mechanical pencil in a state where the push member 3 and the sliding tube are fully depressed toward the axial center of the barrel 1, the top member joining the side members 3*c* of the push member 3 comes into engagement with the high middle slope 42*d* (FIG. 4) of the sliding tube 4 to further advance the sliding tube 4. Since the angular cam portion 4*d* has the high middle slope 42*d* as shown in FIG. 4, the lead advancing stroke of the side knock-type mechanical pencil is greater than that of the side knock-type mechanical pencil employing a sliding tube provided with an angular cam portion having a single slope. Since the axis of the back portion 4*c* is displaced from the axis of the barrel 1 to a side opposite the side of the push member 3 as shown in FIG. 4, the working stroke of the push member 3 can be increased.

When replenishing the side knock-type mechanical pencil with new leads, the eraser 12 is removed from the eraser holding portion 11*b* of the eraser holding member 11 and the new leads are supplied through the eccentric opening 11*bb* into the barrel 1. The leads slide through the back portion of the barrel 1, and then enter the sliding tube 4 through the oval opening 4*f* formed in the funnel-shaped lead receiving portion 4*e*. Each lead slides through the lead passage 4*h* of the sliding tube 4 and reaches the lead chuck 5. Thus, the side knock-type mechanical pencil can be very easily replenished with leads, and the back portion of the barrel 1 serves as a lead tank of a large spare lead storage capacity.

It occurs sometimes that the spring portion 7*b* of the plastic cushion sleeve 7 bends and makes the fitting of the projections 7*c* in the holes 1*b* of the barrel 1 difficult when assembling the component parts of the side knock-type mechanical pencil. Therefore, it has been usual to use a jig to insert the cushion sleeve 7 in and to set the same in place in the barrel 1. In the side knock-type mechanical pencil of the present invention, the sliding tube 4 has the step 4*ab* between the front portion 4*a* and the middle portion 4*b* thereof, and the step 4*ab* engages with the projections 7*c* of the cushion sleeve 7 while causing the cushion sleeve 7 to be compressed when setting the cushion sleeve 7 in place in the barrel 1. Thus, the cushion sleeve 7 can be easily and properly set in place in the barrel 1.

Since the back portion 4*c* of the sliding tube 4 is eccentric with respect to the barrel 1, the sliding tube 4 must be inserted in the barrel 1 in a special angular position relative to the barrel 1 and must be restrained from turning relative to the barrel 1. Since the barrel 1 of the mechanical pencil of the present invention has the longitudinally extending rib 1*a*, and the sliding tube 4 is provided with the longitudinally extending groove 4*g* (FIG. 4), the angular position of the sliding tube 4 relative to the barrel 1 can be simply and surely determined.

In FIGS. 6 to 8, indicated at 1*d* is a stopping step formed in the inner circumference of the barrel 1 so as to engage with the front surface of the angular cam portion 4*d* to limit the advancement of the sliding tube 4. The position of the stopping step 1*d* is dependent on the stroke of the slider 9. The position of the stopping step 1*d* must be determined so that the front surface of the angular cam portion 4*d* comes into contact with the stopping step 1*d* after the slider 9 has been brought into contact with the front end of the inner surface of the head cap 2.

As is apparent from the foregoing description, in the side knock-type mechanical pencil according to the present invention, the working stroke of the push member can be sufficiently increased without increasing the diameter of the barrel and is great for the diameter of the barrel. Therefore, the side knock-type mechanical pencil exercises improved lead advancing performance.

The side knock-type mechanical pencil of the present invention is provided with the side-push mechanism comprising a relatively small number of parts, the cushion sleeve and the like can be assembled by simple assembling work, and the side knock-type mechanical pencil can be easily assembled and can be manufactured at a low manufacturing cost.

What is claimed is:

1. A side knock-type mechanical pencil comprising:

a barrel;

an advancing member;

a sliding member longitudinally slidably inserted in the barrel and internally provided with a lead passage; and an angular cam portion formed in a middle portion of the sliding member, with the angular cam portion having a stepped surface consisting of a high slope and a pair of low slopes, with the advancing member touching the pair of low slopes in an initial stage of a pushing operation, and the advancing member touching the high slope in a final stage of the pushing operation.

2. The side knock-type mechanical pencil according to claim 1, wherein the sliding member has a lead receiving portion shaped as a funnel, and an eccentric opening connected to the lead passage is formed in the lead receiving portion.

3. The side knock-type mechanical pencil according to claim 1, wherein the sliding member is provided with an external longitudinal groove, and the barrel is provided with an internal longitudinal rib mating with the external longitudinal groove of the sliding member.

4. The side knock-type mechanical pencil according to claim 1, wherein the outside diameter of a back end portion of the sliding member is approximately equal to an inside diameter of the barrel.

5. The side knock-type mechanical pencil according to claim 1, wherein the sliding member further comprises an offset portion of the sliding member with the offset portion having an axis that is offset from the main axis of the sliding member, with the offset portion being located adjacent to the advancing member and being offset away from the advancing member.

6. The side knock-type mechanical pencil according to claim 1, wherein the advancing member is a push member pivotally supported on the barrel.

7. The side knock-type mechanical pencil according to claim 6, wherein the push member further comprises:

a pair of side members touching the pair of low slopes in the initial stage of the pushing operation; and a top member which joins the pair of side members, with the top member touching the high slope in the final stage of the pushing operation.

8. A side knock-type mechanical pencil comprising:

a barrel;

an advancing member;

a sliding member having a main axis and longitudinally slidably inserted in the barrel and internally provided with a lead passage; and an offset portion of the sliding member, with the offset portion having an axis that is offset from the main axis of the sliding member, with the offset portion being located juxtaposed to the advancing member and being offset away from the advancing member.

9. The side knock-type mechanical pencil according to claim 8, wherein the outside diameter of a back end portion of the sliding member is approximately equal to an inside diameter of the barrel.

10. The side knock-type mechanical pencil according to claim 8, wherein the sliding member has a lead receiving portion shaped as a funnel, and an eccentric opening connected to the lead passage is formed in the lead receiving portion.

11. The side knock-type mechanical pencil according to claim 8, wherein the sliding member is provided with an external longitudinal groove, and the barrel is provided with an internal longitudinal rib mating with the external longitudinal groove of the sliding member.

12. The side knock-type mechanical pencil according to claim 8, wherein the sliding member further comprises an angular cam portion formed in the offset portion of the sliding member, with the angular cam portion having a stepped surface consisting of a high slope and a pair of low slopes, with the advancing member touching the pair of low slopes in an initial stage of a pushing operation, and the advancing member touching the high slope in a final stage of the pushing operation.

13. The side knock-type mechanical pencil according to claim 8, wherein said advancing member is a push member pivotally supported on the barrel.

14. The side knock-type mechanical pencil according to claim 13 wherein the push member further comprises:

a pair of side members touching the pair of low slopes in the initial stage of the pushing operation; and a top member which joins the pair of side members, with the top member touching the high slope in the final stage of the pushing operation.

15. A side knock-type mechanical pencil comprising:

a barrel;

a sleeve inserted in the barrel;

an advancing member; and a sliding member having a stepped forward portion, an angular cam portion with which the advancing member comes into contact, and a lead receiving portion extending behind the angular cam portion and having an outside diameter approximately equal to the inside diameter of the barrel, and provided with an axial lead passage extended through the angular cam portion and the lead receiving portion, and having a lower portion located inside the sleeve;

wherein the stepped forward portion of the sliding member pushes a projection formed in the sleeve into a hole formed in the barrel when fitting the projection of the sleeve in the hole of the barrel.

16. The side knock-type mechanical pencil of claim 15, wherein the sliding member further comprises a one-piece sliding member.

17. The side knock-type mechanical pencil according to claim 15, wherein the sliding member is provided with an external longitudinal groove, and the barrel is provided with an internal longitudinal rib mating with the external longitudinal groove of the sliding member.

18. The side knock-type mechanical pencil according to claim 15, wherein the sliding member further comprises an offset portion of the sliding member with the offset portion having an axis that is offset from the main axis of the sliding member, with the offset portion being located adjacent to the advancing member and being offset away from the advancing member.

19. The side knock-type mechanical pencil according to claim 15, wherein said advancing member is a push member pivotally supported on the barrel.

20. The side knock-type mechanical pencil according to claim 19, wherein the push member further comprises:

a pair of side members touching the pair of low slopes in the initial stage of the pushing operation; and a top member which joins the pair of side members, with the top member touching the high slope in the final stage of the pushing operation.

* * * * *